United States Patent [19]

Wherry

[11] 4,430,783

[45] Feb. 14, 1984

[54] METHOD OF MAKING A ROCKER ARM

[75] Inventor: Joseph L. Wherry, Perrysburg, Ohio

[73] Assignee: Toledo Stamping & Manufacturing Company, Toledo, Ohio

[21] Appl. No.: 410,355

[22] Filed: Aug. 23, 1982

Related U.S. Application Data

[62] Division of Ser. No. 134,447, Mar. 27, 1980, Pat. No. 4,346,678.

[51] Int. Cl.[3] ..... B23P 15/00; B21D 53/84

[52] U.S. Cl. ..... 29/156.4 R; 29/423; 228/173 C; 72/379; 123/90.39

[58] Field of Search ..... 29/156.4 R, 423, 411, 29/150; 123/90.39, 90.33, 90.44, 90.46; 72/379; 228/173 C, 182, 160, 159, 174, 141.1

[56] References Cited

U.S. PATENT DOCUMENTS

| | | | |
|---|---|---|---|
| 1,278,195 | 9/1918 | Noack | 123/90.33 |
| 2,199,914 | 5/1940 | Haberstump | 123/90.39 |
| 2,219,361 | 10/1940 | Haberstump | 123/90.39 |
| 2,272,166 | 2/1942 | Leake | 123/90.39 |
| 2,478,130 | 8/1949 | Ronfeldt | 123/90.39 |
| 2,905,160 | 9/1959 | Sampietro | 72/379 |
| 2,917,033 | 12/1959 | Brogren | 72/379 |
| 3,032,861 | 5/1962 | Foster | 228/159 |
| 3,096,749 | 7/1963 | Davidson | 123/90.39 |
| 3,410,366 | 11/1968 | Winter, Jr. | 123/90.39 |
| 3,453,715 | 7/1969 | Rogers | 228/173 C |
| 3,875,908 | 4/1975 | Ayres | 123/90.44 |
| 4,132,196 | 1/1979 | Wherry | 123/90.46 |

FOREIGN PATENT DOCUMENTS

| | | | |
|---|---|---|---|
| 993747 | 7/1976 | Canada | 29/156.4 R |
| 2304772 | 10/1976 | France | 123/90.39 |

*Primary Examiner*—Daniel C. Crane
*Attorney, Agent, or Firm*—Allen D. Gutchess, Jr.

[57] ABSTRACT

A rocker arm and method of making same are provided. The rocker arm is of the cam-follower type and is preferably made from a stamped metal piece and a stamped metal strip, the latter preferably being of a hardened alloy. A rounded recess is formed at one end portion of the metal piece and facing away from the metal strip to receive a lifter post having an end on which the rocker arm can pivot. The metal piece also has an additional recess at another end portion to receive an end of a valve stem. The metal strip has an intermediate convex portion facing away from the metal piece to be engaged by a cam. The metal piece has a hole extending through the piece and communicates with the rounded recess while the strip forms a groove communicating with the hole and extending toward the convex portion to supply lubricating fluid from the convex portion to the rounded recess. After the metal piece and the strip are partially stamped, end tabs thereon are welded together and the contiguous portions are brazed, further stamped, and finish formed. The end tabs are then removed and the resulting rocker arm is heat treated and cleaned to complete the process.

6 Claims, 10 Drawing Figures

METHOD OF MAKING A ROCKER ARM

This is a division of application Ser. No. 134,447 filed Mar. 27, 1980, now U.S. Pat. No. 4,346,678 issued Aug. 31, 1982.

This invention relates to a rocker arm of the cam-follower type and to a method of making same.

Rocker arms of the cam-follower type are generally cast, although a stamped rocker arm is disclosed in Canadian Pat. No. 993,747, issued on July 27, 1976.

The present invention provides a two-piece, stamped rocker arm of the cam-follower type which is made from a stamped metal piece and a stamped metal strip. The metal strip is preferably made of a long-wearing alloy. The new rocker arm is strong and yet lighter in weight than many of those heretofore known. The rocker arm is also low in cost and requires minimum machining operations.

A first, rounded recess is formed in one end portion of the stamped metal piece and a second recess is formed in another end portion of the metal piece. The first, rounded recess receives the upper end of a lifter post while the other recess receives an end of a valve stem. A convex portion is formed on an intermediate portion of the stamped strip and faces away from the metal piece. The convex portion is designed to be engaged by a cam so that the rocker arm can operate the valve stem with the lifter post being a pivot.

A lubricating hole is formed in the rounded recess and extends through the metal piece. A groove is formed in the strip and communicates at one end portion with the convex portion of the strip and at the other end portion with the lubricating hole. In this manner, lubricating fluid supplied through the cam flows down the groove into the hole to provide lubrication for the rounded recess and the upper end of the lifter post.

In the manufacture of the rocker arm, the metal piece and the metal strip are first partially formed by stamping operations, with both the metal piece and the strip having tabs projecting from both ends. When the piece and end strip are partially shaped, the strip is placed in contiguous relationship with the metal piece and the end tabs are projection welded together to hold the piece and strip in contiguous relationship. The assembly is then brazed and, after further forming, the welded tabs are removed and the assembly is finish formed, coined, and pack backed with a lubricating hole pierced through the metal piece. The rocker arm is then heat treated and cleaned.

It is, therefore, a principal object of the invention to provide a rocker arm having the features and lubricating provisions discussed above.

Another object of the invention is to provide a method of making the rocker arm.

Other objects and advantages of the invention will be apparent from the following detailed description of a preferred embodiment thereof, reference being made to the accompanying drawings, in which.

Figure 1:
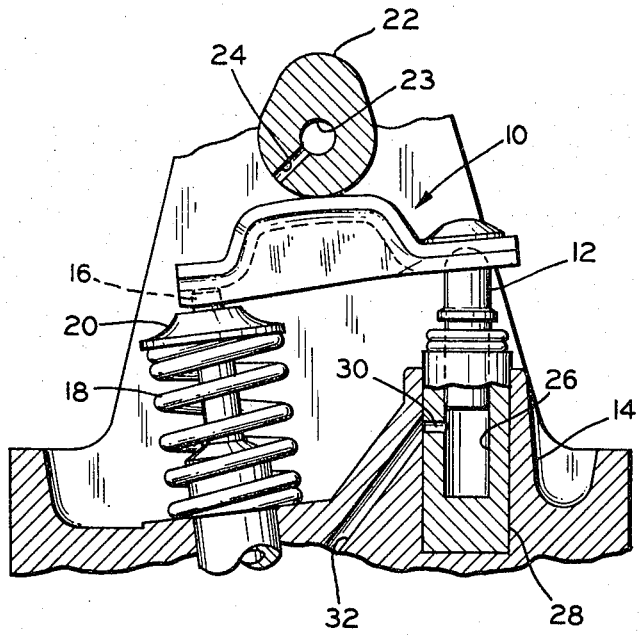
FIG. 1 is a somewhat schematic view in cross section, with portions in elevation, of valve actuating mechanism including a rocker arm in accordance with the invention.

Referring particularly to FIG. 1, a rocker arm of the cam-follower type is indicated at 10 and has one end received on a rocker arm fulcrum or lifter post 12 extending upwardly from a cylinder head 14 of an internal combustion engine. The other end portion of the rocker arm 10 engages an upper end of a valve stem 16. The valve stem extends upwardly from the cylinder head 14 through a coiled compression spring 18 located therearound and which is seated against the cylinder head and against a retainer seat 20 mounted on the stem 16. An overhead cam 22 engages an intermediate portion of the rocker arm 10 to cause a valve located at the lower end of the valve stem 16 to open and close as the stem is moved longitudinally by the rocker arm 10. Oil or other lubricating fluid is supplied through a central passage 23 in the cam shaft of the cam 22 and to a transverse passage 24 from which it flows to the intermediate surface of the rocker arm 10 for lubricating purposes.

The lifter post or fulcrum 12 is slidably carried in a chamber 26 of a cylinder 28. The post 12 is urged upwardly by fluid such as oil under pressure in the chamber 26 which is supplied through a small port 30 from a supply passage 32. The post 12 thereby can yield somewhat when the cam 22 is rotated. In practice, the post 12 moves down slightly at the high lobe of the cam 22 to provide a zero lash adjustment for the rocker arm 10. The port 30 is of a size to provide for controlled leakage of the oil from the chamber 26 to control pressure of the oil therein.

Figure 2:
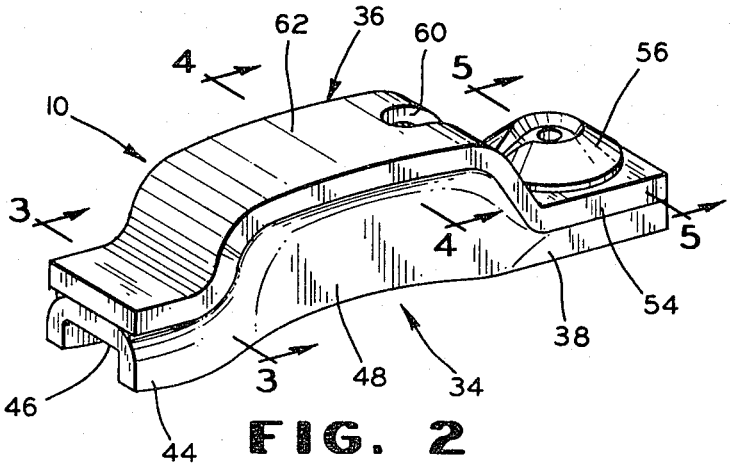
FIG. 2 is an enlarged view in perspective of the rocker arm of FIG. 1.
Figure 3:
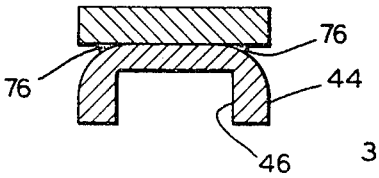
FIGS. 3–5 are somewhat schematic views in transverse cross section, taken along the lines 3—3, 4—4, and 5—5 of FIG. 2.
Figure 4:
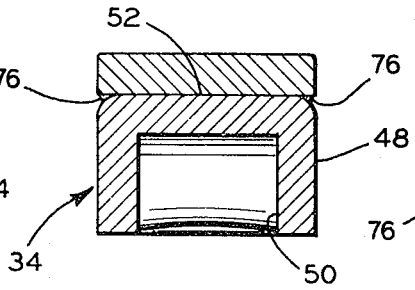
Figure 5:
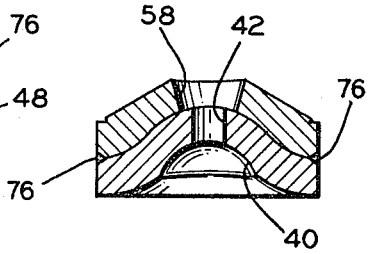

Referring more particularly to FIG. 2, the rocker arm 10 preferably is made from a stamped metal piece 34 and a stamped metal strip 36. The right end of the metal piece 34 has an end portion 38 in which is formed a first, rounded recess 40 (FIG. 5) to receive the upper rounded end of the lifter post 12. A lubricating hole 42 extends through the end portion 38 of the piece 34 to supply lubricant to the surfaces of the recess 40 and the post 12. Another end portion 44 of the piece 34 has a recess 46 formed therein to receive the upper end to the valve stem 16. An intermediate portion 48 of the metal piece 34 has a deep void 50 formed therein with a generally convex upper surface 52.

The stamped metal strip 36 preferably is made of a long wearing alloy to enable the rocker arm 10 to withstand the sliding contact with the cam 22 without excessive wear. The strip 36 has an end portion 54 with a truncated conical projection 56 extending upwardly therefrom and forming an enlarged end or reservoir 58 of a groove or slot 60 formed in the strip 36. The groove 60 extends from the end 58 upwardly to an intermediate, convex surface 62 at an intermediate portion of the rocker arm strip 36 and facing away from the metal piece 34. The groove 60 can be formed in the strip 36 alone or it can, as shown, be formed as a slot in the strip 36 with the bottom formed by the upper surface of the metal piece 34. In either event, the lubricating fluid or oil supplied from the passage 24 to the convex surface 62 can flow down the groove 60, into the reservoir 58, and through the hole 42 to supply lubrication for the recess 40 and the upper end of the post 12. Of course, lubricant from the passage 24 also lubricates the surfaces of the cam 22 and the convex surface 62.

Figure 6:
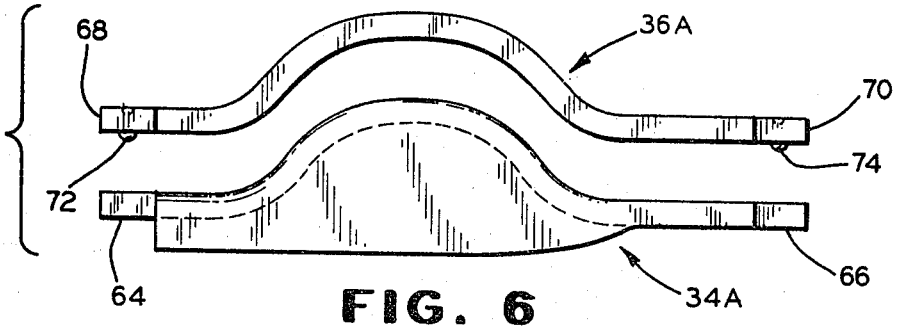
FIGS. 6 and 7 are schematic views in elevation of the metal piece and the metal strip in different shaping stages.

The method of making the rocker arm 10 will now be discussed in connection with FIGS. 6–10. Referring to FIG. 6, a partially-formed stamped metal piece 34A corresponding to the stamped piece 34 and a partially-formed stamped metal strip 36A corresponding to the strip 36 are shown in spaced relationship. The piece 34A has a partially-formed intermediate portion and two projecting end tabs 64 and 66, to be discussed shortly. The strip 36A also has a partially-formed intermediate portion and two end tabs 68 and 70 with downwardly-extending projections 72 and 74. At this time, the slot also has been formed in the strip 36A to provide the groove 60.

Figure 7:
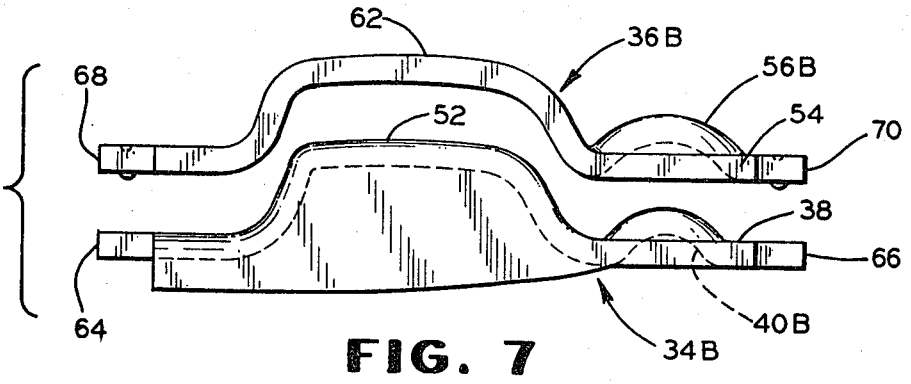

Referring to FIG. 7, a stamped metal piece 34B corresponding to the piece 34 and a stamped strip 36B corresponding to the strip 36 are shown. The stamped piece 34B has the intermediate portion with the surface 52 substantially completely formed at this time and a recess 40B corresponding to the recess 40 has now been formed in the end portion 38. Similarly, the intermediate portion 62 of the strip 36B is now substantially completely formed and a projection 56B corresponding to the truncated-conical projection 56 is formed in the end portion 54 above the recess 40B.

Figure 8:
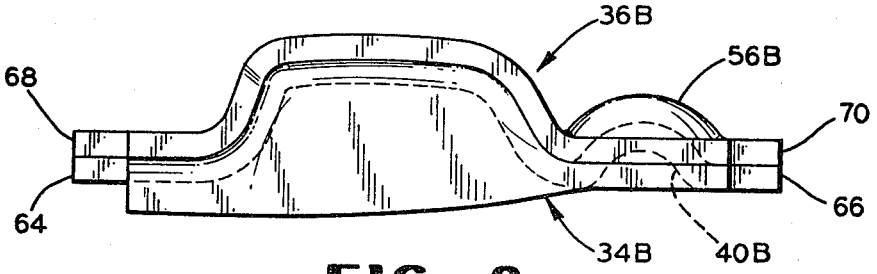
FIG. 8 is a somewhat schematic view in elevation of the metal piece and metal strip in assembled relationship.
Figure 9:
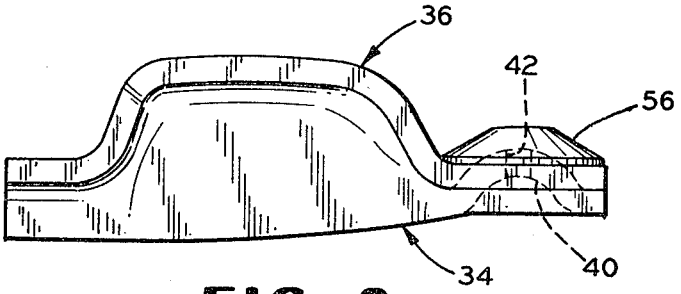
FIG. 9 is a somewhat schematic view in elevation of the assembly after further stamping operations.

The parts 34B and 36B are then projection welded together as shown in FIG. 8 with the tabs 64 and 68 welded and the tabs 66 and 70 welded. The lower surface of the part 36B is in contiguous relationship with the upper surface of the piece 34B at this time. The parts are then affixed together by braze metal 76 (FIGS. 3–15) and the assembly is then annealed. The assembly is then restruck and the side flanges of the intermediate portion of the stamped piece 34B are packbacked to square them. The tabs and the projection welding provide a relatively inexpensive and efficient manner of holding the piece 34 and strip 36 in contiguous relationship during brazing and subsequent operations.

Figure 10:
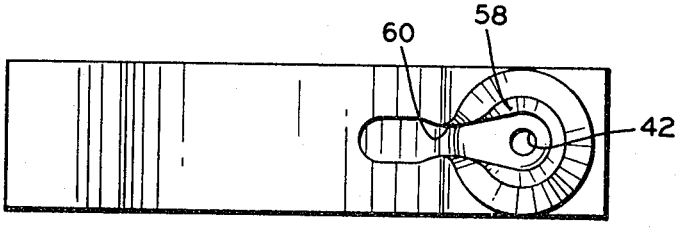
FIG. 10 is a top view of the rocker arm of FIG. 9.

The tabs 64, 68 and 66,70 are then trimmed. The assembly is finish formed and the projecting portion 56B is finish formed and coined to form the truncated-conical projection 56. When the projection 56B is formed and subsequently finished to form the truncated conical portion 56, the enlarged end 58 of the slot or groove 60 automaticaly is formed, and the opposite end of the slot 60 and also tends to be enlarged when the intermediate portion 52 of the strip 36 is formed, as shown in FIG. 10. The curved cam surface 62, the spherical surface of the recess 40, and the curved surface for valve recess 46 are also coined to eliminate machining operations. The lubricating hole 42 is then pierced in the piece 34 to complete the rocker arm, except for heat treating and abrasive tumbling or other cleaning.

Various modifications of the above described embodiment of the invention will be apparent to those skilled in the art, and it is to be understood that such modifications can be made without departing from the scope of the invention, if they are within the spirit and the tenor of the accompanying claims.

I claim:

1. A method of making a stamped rocker arm of the cam-follower type comprising providing an upper metal strip and a lower metal piece, forming a rounded recess in an end portion of the metal piece to receive a lifter post having an end on which said rocker arm can pivot, forming an additional recess at another end portion of said metal piece to receive an end of a valve stem, forming a generally convex portion in said metal piece between said rounded recess and said additional recess, forming an intermediate convex portion on said metal strip to be engaged by a cam, and forming a slot in said metal strip extending at least to said convex portion thereof and to one end portion thereof, affixing said metal strip to said metal piece whereby said slot forms a lubricant groove with a portion of said metal piece and with the convex portion of said metal piece being in contiguous relationship with said intermediate convex portion of said metal strip, and forming a hole through said metal piece communicating with said rounded recess and with said strip slot at the one end portion of said strip.

2. A method of making a rocker arm of the cam-follower type comprising forming a body having an upper metal strip and a lower metal piece, forming a rounded recess in an end portion of said metal piece to receive a lifter post having an end on which said rocker arm can pivot, forming a hole in said metal piece communicating with said rounded recess, forming an additional recess at another end portion of said metal piece to receive an end of a valve stem, forming a deep void in said metal piece between said rounded recess and said additional recess with a generally convex surface and with depending flanges on each side of said void, forming an intermediate convex portion on said metal strip for engagement with a cam, forming a lubricant passage in said metal strip extending from one end portion of said metal strip and at least to said convex portion of said metal strip, and affixing said strip to said metal piece with the generally convex surface of said metal piece being in contiguous relationship with said intermediate portion of said metal strip such that the rounded recess of the metal piece faces away from the metal strip, the depending flanges on said metal piece face away from the metal strip, the intermediate convex portion on said metal strip faces away from the metal piece and the lubricant passage in said metal strip communicates with said hole on said metal piece.

3. A method according to claim 2 characterized by forming said hole in said metal piece after affixing said strip to said metal piece.

4. A method according to claim 2 characterized by at least partially forming said rounded recess in said metal piece after affixing said strip and said piece together to cause an end portion of said passage above said rounded recess to become enlarged around said hole.

5. A method of making a rocker arm of the cam-follower type comprising providing an upper metal strip and a lower metal piece, forming a rounded recess in an end portion of said metal piece to receive a lifter post having an end on which said rocker arm can pivot, forming a hole through said metal piece communicating with said rounded recess, forming an additional recess at another end portion of said metal piece to receive an end of a valve stem, forming a deep void in said metal piece between said rounded recess and said additional recess with a generally convex surface and with depending flanges on each side of said void, forming an intermediate convex portion on said metal strip for engagement with a cam, forming a slot in said metal strip extending from one end portion of said metal strip and at least to said convex portion of said metal strip, and affixing said metal strip to said metal piece with the generally convex surface of said metal piece being in contiguous relationship with said intermediate portion of said metal strip such that the rounded recess of the metal piece faces away from the metal strip, the depending flanges on said metal piece face away from the metal strip, the intermediate convex portion on said metal strip faces away from the metal piece and the lubricant passage in said metal strip communicates with said hole on said metal piece.

6. A method according to claim 5 characterized by at least partially forming said round recess in said metal piece after affixing said strip and said piece together to cause an end portion of said slot above said rounded recess to become wider around said hole.

* * * * *